United States Patent [19]

Clements

[11] 3,952,955

[45] Apr. 27, 1976

[54] SAFETY TIP GUARD

[75] Inventor: William Clements, St. Louis Park, Minn.

[73] Assignee: Graco Inc., Minneapolis, Minn.

[22] Filed: Dec. 12, 1974

[21] Appl. No.: 532,021

[52] U.S. Cl. ..... 239/288.5; 239/599

[51] Int. Cl.[2] ..... B05B 1/04

[58] Field of Search ..... 239/288, 288.3, 288.5, 239/526, 596, 599, 600, 601, 597

[56] References Cited

UNITED STATES PATENTS

| | | | |
|---|---|---|---|
| 1,151,258 | 8/1915 | Fischer | 239/596 |
| 2,518,895 | 8/1950 | Jacobsson et al. | 239/288 |
| 2,755,137 | 7/1956 | Hughf | 239/288.5 |
| 3,140,713 | 7/1964 | Ismach | 239/288.5 X |
| 3,556,411 | 1/1971 | Nord et al. | 239/599 X |

*Primary Examiner*—John J. Love

*Attorney, Agent, or Firm*—Paul L. Sjoquist

[57] ABSTRACT

Apparatus is disclosed for fitting over the spray tip end of an airless paint spray gun, wherein the apparatus comprises a pair of forwardly projecting ears and a narrow slotted region opening said spray tip, and is adapted for key alignment with the spray tip.

3 Claims, 3 Drawing Figures

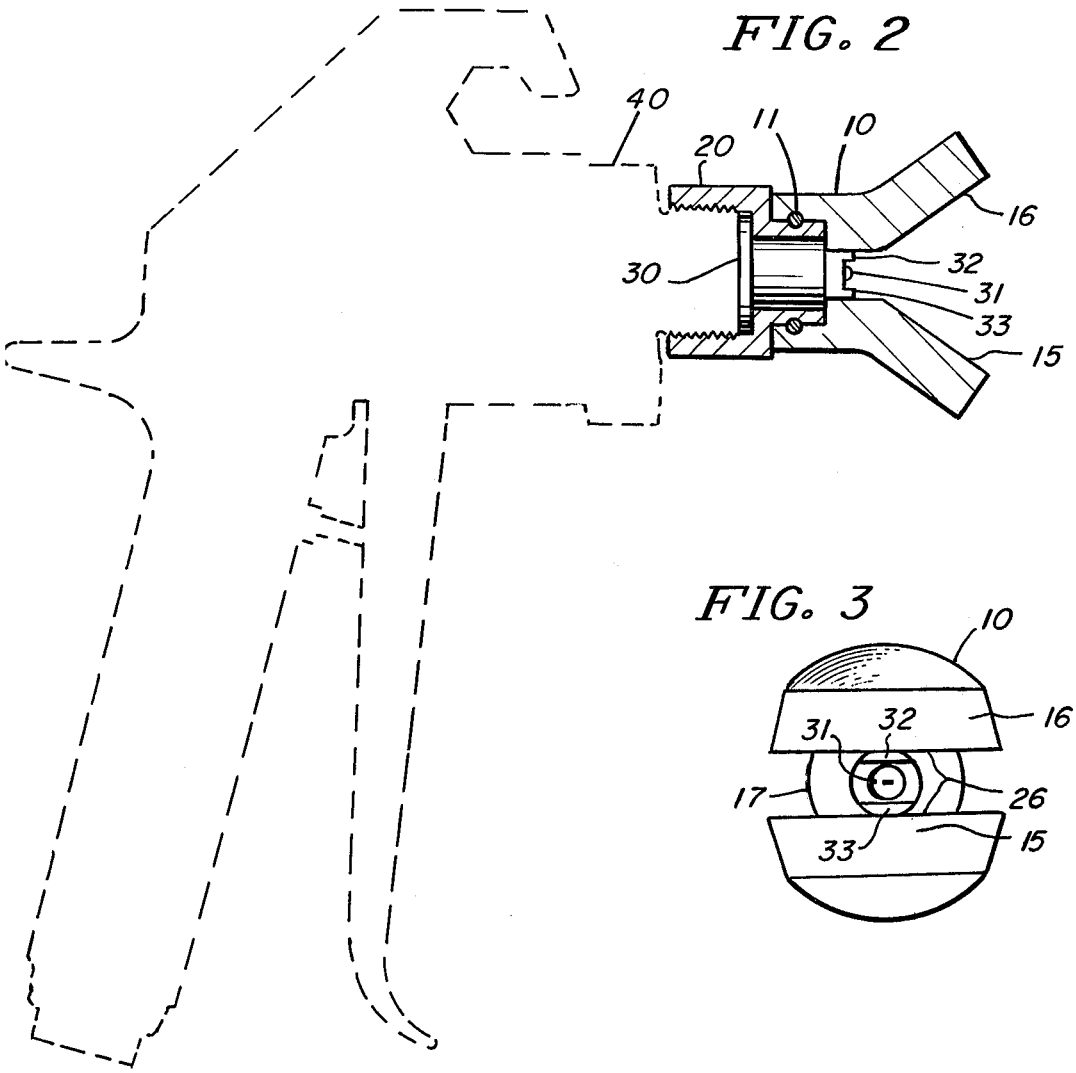
FIG. 2
40
20
11
10
16
30
32
31
33
15
FIG. 3
10
16
31
32
17
26
33
15
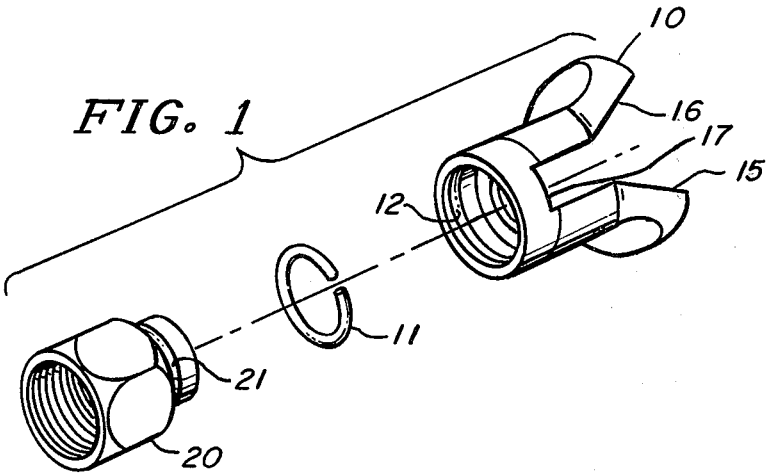
FIG. 1
10
16
17
15
12
11
21
20

SAFETY TIP GUARD

BACKGROUND OF THE INVENTION

This invention relates to the field of spray painting apparatus such as spray guns and the like, and more specifically relates to spray guns of the type which are operated under high hydraulic fluid pressures and which utilize such pressures to assist in the atomization of the paint spray. Such paint spray apparatus may utilize hydraulic fluid pressures in the range of up to 2,000 pounds per square inch (psi). The highly pressurized paint fluid is forced through a very small paint spray orifice which is conventionally formed at the tip of a spray gun. Such spray orifices are typically of cross-sectional area of 0.0001 to 0.0007 square inches and are constructed from carbide steel in order to withstand the abrasive effects of high pressure, high velocity paint. The orifices are usually elliptical in shape and create a corresponding elliptical point spray pattern which is useful for obtaining the desired paint coverage on an article.

Since the spraying and atomizing of the paint is accomplished under high hydraulic fluid pressures, rather than under the influence of an auxiliary air source, this technique of painting is commonly referred to as "airless" spraying. One of the disadvantages inherent with apparatus which itilize the airless spraying technique is the potential for causing physical injury to a person coming in contact with the high velocity paint spray particles near the outlet of the spray orifice. When one examines the physical characteristics of a spray pattern emitted from an airless spray gun it is seen that the paint particles retain a partially-atomized fan-shaped characteristic for a distance of approximately ¼ – 1 inch from the spray orifice, and thereafter they become fully atomized into fine droplets which are propagated forwardly to be deposited upon the article to be coated. Physical contact with the paint droplets after they have become atomized is generally harmless, for they have a reduced velocity which is insufficient for penetration of the skin. However, physical contact with the thin liquid paint sheet near the end of the spray orifice can have serious harmful effects, for the velocity of the paint particles in this region is high enough to penetrate the skin of a person, and can cause infection which may require medical treatment. It is therefore advantageous to provide some means for protecting the region near a paint spray orifice from coming into contact with any portion of a person's body. Of course, the form of protection selected to accomplish this purpose must also provide a paint spray operation without degradation or hindrance of the paint spray pattern.

In the prior art, various shielding mechanisms have been devised to project externally of the spray orifice and thus prevent human contact from a region near the orifice. However, these devices have suffered from the disadvantage that they often accumulate paint residue because of their proximity to the paint orifice, and further, they have sometimes interferred with the desired paint spray pattern being emitted from the spray gun. Other attempts at minimizing the harmful effects of inadvertent contact with the paint stream near the outlet of a paint orifice have dealt with providing various safety mechanisms to the spray gun trigger actuating apparatus. For example, co-pending U.S. patent application Ser. No. 450,927 owned by the same assignee as the present invention, provides one approach to disabling a spray gun actuating trigger whenever the spray tip orifice is being removed for cleaning or replacement. Various other trigger safety mechanisms have been utilized in the prior art to minimize the problem of inadvertent triggering of the spray gun.

The present invention provides an apparatus for fitting over the end of an existing spray gun and thereby preventing close physical contact by the operator or others to the region near the paint spray orifice. The invention further accomplishes this safety function without disturbing or interferring with the paint spray pattern being emitted from the spray gun. Further, the invention is adapted for convenient alignment with the elliptical spray orifice in a manner which always insures that the spray pattern is unencumbered. Further, the invention is removable with the spray tip when such removal becomes necessary for cleaning or other purposes, and is replaceable with the spray tip in a manner which retains the desired alignment with the elliptical spray orifice.

SUMMARY OF THE INVENTION

The present invention comprises a fan-shaped safety guard which attaches to the end of the spray gun spray tip retainer by means of a spring clip connection, and which has thereon an inlet opening complementary-shaped to the externally projecting spray tip commonly used in apparatus of this type. The complementary-shaped opening on the invention enables the invention to be rotated in alignment with the spray orifice in a manner which allows the orifice to be removed and replaced without further concern about the proper alignment of the spray guard. Further, the forward shape of the present invention accommodates the shape of spray patterns currently being used by state-of-the-art spray guns, and does not inhibit in any manner the proper shaping of such spray patterns for maximum utility in spraying articles to be coated.

BRIEF DESCRIPTION OF THE DRAWINGS

A preferred embodiment of the present invention is illustrated in the drawings attached hereto, in which:

FIG. 1 illustrates in perspective view the invention and typical spray gun tip retainer nut;

FIG. 2 illustrates in partial cross section the invention attached to a spray gun;

FIG. 3 illustrates the rear view of the invention.

DESCRIPTION OF THE PREFERRED EMBODIMENT

Referring first to FIG. 1, the invention is shown in side perspective view. The safety guard 10 of the present invention is used in conjunction with a spring expansion ring 11, both of which are fitted over a spary tip retainer nut 20. Spring expansion ring 11 fits inside of the rear interior portion 12 of safety adapter 10, wherein a grooved channel of sufficient depth has been cut. Adapter 10, with spring 11 inserted, is then snapped over the end of tip retainer nut 20 so that spring 11 rests in groove 21. In this position, adapter 10 is securely and rotatably attached to tip retainer nut 20, and may not be removed therefrom. Guard 10 has two outwardly beveled interior surfaces 15 and 16 which are shaped to allow the expanding paint spray pattern to pass thereby without interference. A slot 17 is cut through the entire forward center surface of guard 10. Slot 17 is about ¼-inch wide, and it provides full freedom for vertical expansion of the spray pattern as will be hereinafter described.

FIG. 2 shows the invention attached to a spray gun 40 in top view, and in cross section. Guard 10 is first clamped over tip retainer nut 20 together with spring clip 11 as hereinbefore described. A spray tip 31 and its associated tip holder 30 are inserted into the rear opening of guard 10, and spray tip retainer nut 20 is then threaded over the end of spray gun 40. Tip holder 30 is typically constructed having two flat forward surfaces which form shoulders 32 and 33 on either side of spray tip 31.

The outer dimensions of shoulders 32 and 33 fit within a complementary shaped opening at the rear of adapter 10, which is best seen with reference to FIG. 3. Shoulders 32 and 33 slide into opening 26 adjacent the flat surfaces therein, which serve to key the tip holder 30 relative to guard 10. It is standard commercial practice in this art for manufacturers of spray tips and tip holders to bond the spray tip and its holder together to form a single component having the elliptical spray orifice aligned in parallel alignment with shoulders 32 and 33. Therefore, aligning the flat surfaces created by shoulders 32 and 33 against the flat surfaces of interior opening 26 ensures that the elliptical orifice will be parallel to slot 17 at the front of guard 10. The construction of guard 10 and placement of opening 26 also allows the rotation of tip holder 30 in keyed relationship with guard 10 whenever guard 10 is turned or rotated about the axis of tip retainer nut 20.

In typical operation, tip retainer nut 20 is threaded onto spray gun 40 after guard 10 has been attached and spray tip holder 30 has been inserted. The tip retainer nut 20 is threaded until it is finger-tight against gun 40, and then guard 10 is grasped and rotated until slot 17 is substantially vertical (which means that the spray orifice is also vertical) and tip retainer nut 20 is then further tightened with a wrench. When the spray gun 40 is operated with guard 10 so positioned, the thin paint sheet emitted from the spray orifice will be vertically aligned and entirely confined within slot 17. Since slot 17 is too narrow admitting any portion of a person's body, there is no way for the dangerous, high velocity paint particles in the thin, partially atomized spray to contact and penetrate the skin of a person's body.

It is therefore apparent that the preferred embodiment of this invention, as described herein, provides for a safety tip guard which prevents human contact with dangerous, high velocity paint particles, while at the same time not interfering with the quality of the emitted spray pattern, and also provides a means for adjusting the alignment of the spray orifice and maintains a keyed alignment therewith.

What is claimed is:

1. A safety guard apparatus for use in conjunction with an airless paint spray gun and spray tip, comprising:

a. a tip retainer nut sized and threaded to secure said spray tip against said spray gun with said spray tip protruding therethrough, said tip retainer nut having a forward circumferential flat surface with a circumferential groove therein;

b. a safety guard having forwardly projecting ears and a rearward cylindrical portion sized to fit over said tip retainer nut circumferential flat surface, said cylindrical portion having an inner circumferential groove in substantial alignment with said tip retainer nut circumferential groove when said rearward cylindrical portion is fitted over said circumferential flat surface, said safety guard having an internal slotted opening mated to accept said spray tip in keyed alignment therewith, said safety guard having a narrow slotted region, of width less than one-half inch, intermediate said forwardly projecting ears and opening said spray tip forwardly through said safety guard, and said ears each comprising a member shaped for outward divergence from the axis of said spray gun in the forward direction, said member having an inner beveled surface joining said narrow slotted region; and c. a compressible spring clip held in compressed relation within both said tip retainer circumferential groove and said cylindrical portion inner circumferential groove.

2. The apparatus of claim 1 wherein said internal slotted opening further comprises a partial circular area adjacent opposing and parallel flat surfaces.

3. The apparatus of claim 2 wherein said ears project forward a distance approximately equal to the depth of said intermediate slotted region.

* * * * *